US005517003A

United States Patent [19]

Kadooka et al.

[11] Patent Number: 5,517,003

[45] Date of Patent: May 14, 1996

[54] SELF-REGULATING HEATER INCLUDING A POLYMERIC SEMICONDUCTOR SUBSTRATE CONTAINING POROUS CONDUCTIVE LAMPBLACK

[75] Inventors: Humberto T. Kadooka, no Estado de Sao Paulo; Ricardo P. Moreno, Sao Paulo; Olavo N. Da Costa, nó Estado de Sao Paulo, all of Brazil

[73] Assignee: Metagal Industria E Comercio Ltda., Sao Paulo, Brazil

[21] Appl. No.: 85,014

[22] Filed: Jun. 29, 1993

[51] Int. Cl.[6] ..... H05B 3/10; H05B 3/14

[52] U.S. Cl. ..... 219/548; 219/543

[58] Field of Search ..... 219/548, 549, 219/528, 543

[56] References Cited

U.S. PATENT DOCUMENTS

| | | | |
|---|---|---|---|
| 3,056,750 | 10/1962 | Pass | 219/549 |
| 3,412,358 | 11/1968 | Hummel | 219/548 |
| 3,858,144 | 12/1974 | Bedard | 219/549 |
| 4,169,819 | 10/1979 | Shiohara | 524/311 |
| 4,514,620 | 4/1985 | Cheng | 219/553 |
| 4,908,156 | 3/1990 | Dalle | 219/549 |
| 4,954,695 | 9/1990 | Smith-Johannsen | 219/548 |
| 4,987,164 | 1/1991 | Kauffman | 524/413 |
| 5,198,639 | 3/1993 | Smuckler | 219/543 |

OTHER PUBLICATIONS

Encyclopedia of Chemical Technology, 4th Ed, vol. 4, Kirk Othmer, 1992, pp. 1038, 1039, 1055, 1063 to 1068.

Performance of Conductive Carbon Blacks in a Typical Plastics System, Deanin, et al, 1974, pp. 171 and following.

M. Narkis, et al, "Electrical properties of carbon black filled crosslinked Polyethylene", 1981, vol. 21, No. 16, pp. 1049–1054.

Encyclopedia of Polymer Science and Engineering, vol. 2, 1985, pp. 623–640.

*Primary Examiner*—Teresa J. Walberg
*Assistant Examiner*—Sam Paik
*Attorney, Agent, or Firm*—Michael J. Striker

[57] ABSTRACT

The self-controlled heater for a rearview mirror of a vehicle comprises a semiconductor polymer substrate based on lampblack and consisting essentially of 60% low density polyethylene, 8.5% ethylene vinyl acetate copolymer, 20% conductive lampblack having a porous structure; 4.0% of a spreading agent consisting of calcium stearate; 3.0% of an antioxidant; and 0.5% of a coupling agent consisting of calcium titanate, with a high degree of shearing and a low degree of orientation for lampblack aggregations; a silver ink conductor track printed on the substrate, the conductor track including negative and positive poles having interpenetrating adjacent branches spaced at intervals from each other so as to provide a sufficient amount of heat to defog and defrost the rearview mirror; and two terminals applied to the substrate, one of which is connected to the negative pole and the other of which is connected to the positive pole.

1 Claim, 2 Drawing Sheets

5
+
5
−
10
8
6
7
9
1
3

(CSPBNF)
a
"A"
(I)
(II)
1
"B"
2
4
b
c
d
e
f
5
"C"

SELF-REGULATING HEATER INCLUDING A POLYMERIC SEMICONDUCTOR SUBSTRATE CONTAINING POROUS CONDUCTIVE LAMPBLACK

CROSS-REFERENCES

Reference is made to the copending U.S. patent application Ser. No. 08/085,015, filed Jun. 29, 1993, entitled "SEMICONDUCTOR POLYMERIC COMPOUND BASED ON LAMPBLACK, POLYMERIC SEMICONDUCTOR BODY, AND METHODS OF MAKING THE SEMICONDUCTOR POLYMERIC COMPOUND AND THE POLYMERIC SEMICONDUCTOR BODY".

BACKGROUND OF THE INVENTION

The present invention relates to a method of making a self-controlled heater and improved self-controlled heater.

The polymeric semiconductor compound based on lampblack and consisting essentially of about 60% by weight of low density polyethylene, of about 8.5% by weight ethylene vinyl acetate copolymer, of about 4.0% by weight of a spreading agent consisting of calcium stearate, of about 3.0% by weight of an antioxidant and about 0.5% by weight of a coupling agent consisting of calcium titanate described in the above copending application and the semiconductor body made by extruding and calendering it are useful in making a self-controlled heater. The disclosure of the above copending application should be considered as incorporated by reference in the above application.

SUMMARY OF THE INVENTION

It is an object of the present invention to provide an improved self-controlled heater and method of making the self-controlled heater.

According to the invention, the method of making a self-controlled heater based on lampblack comprising the steps of:

a) making a polymeric semiconductor band composed of a polymeric semiconductor compound based on lampblack and consisting essentially of 60% low density polyethylene, 8.5% ethylene vinyl acetate copolymer, 20% conductive lampblack having a porous structure; 4.0% of a spreading agent consisting of calcium stearate; 3.0% of an antioxidant; and 0.5% of a coupling agent consisting of calcium titanate, this polymeric semiconductor compound being made by incorporating a conductive component including the lampblack in a polymeric matrix by spreading a mixture made from the ion density polyethylene, the ethylene vinyl acetate copolymer, the lampblack, the spreading agent, the antioxidant and the calcium titanate in an intermittent "bambury" type mixer under process conditions selected to obtain a high level of lampblack shearing;

b) molding the polymeric semiconductor band in an "A" phase including the steps of drying for four hours at a temperature of 70° C. in a forced ventilation oven; and forming consisting essentially of I) extruding in an extruder having an entrance funnel maintained at about 200° C., a second extrusion zone at 200° C.; and a third extrusion zone maintained at 200° C., wherein a thread rotation of 1,500 rpm is used for recycled material and 1,200 rpm for virgin material and the pooler is set at 1:150 rpm for recycled material and 2:150 for virgin material; and II) calendering with no water circulation and no pressure and with a distance from calender flap of about 10 mm, flap opening 0.55±0.05 mm so as to form a polymeric semiconductor plate. The method advantageously also includes a "B" phase comprising cutting the polymeric semiconductor plate with a cutting knife to form the appropriate shape or body for the heater and a subsequent "C" phase including printing an electrical conductor track (3) on the plate (2) by means of the following steps:

a) cleaning the plate with alcohol;

b) flaming or slightly burning a surface of plate receiving the electrical conductor track;

c) silk screen printing on a printing table with fixing of the plate under vacuum and contour gauge, with the same contours of the heater model and with the same thickness of plate 2;

d) prior drying at room temperature during a predetermined proper time;

e) drying in a oven at 70° C. during 20 to 30 minutes; and f) fixing terminals on the plate for the electrical conductor track.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENTS

Figure 1:
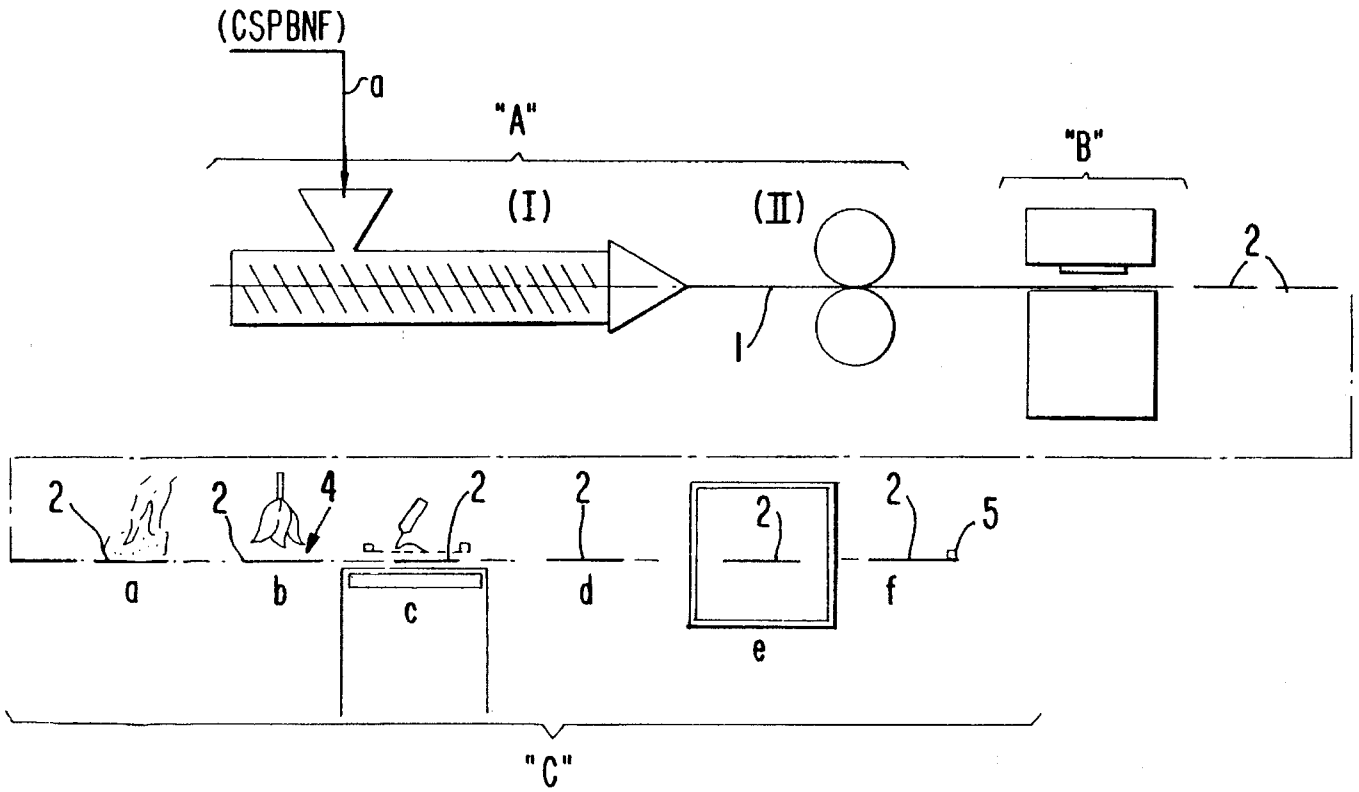
FIG. 1 is a schematic diagram showing the steps in the method of making the heater according to the invention.

The steps in the method according to the invention are illustrated in FIG. 1. First, the polymeric semiconductor compound (CSPBNF) based on lampblack is obtained by the method described in the above-identified copending U.S. patent Application. This semiconductor compound is composed of 60% low density polyethylene (PEBD), 8.5% ethylene vinyl acetate copolymer, 20% conductive lampblack having a porous structure, 4.0% spreading agent composed of calcium stearate, 3.0% antioxidant, and 0.5% calcium titanate as a coupling agent. The lampblack conductive component is incorporated in the polymeric matrix by spreading a mixture of the above components with intermittent "bambury" type mixers under process conditions to obtain a high rate of shearing. The polymeric semiconductor compound is used to make the self-controlled heater.

The method of making the self-controlled heater itself makes use of original and recycled raw material and includes essentially an "A" phase in which a polymeric semiconductor band or strip based on lampblack is molded and which consists of the following steps:

a) drying for 4 hours at a temperature of +70° C. in a forced ventilation oven to remove all moisture;

b) forming the product which includes

I) extruding in an extruder having an entrance funnel maintained at about 200° C., a second extrusion zone at 200° C.; and a third extrusion zone maintained at 200° C. A thread rotation of 1,500 rpm is used for recycled material and 1,200 rpm for virgin material. The pooler is set at 1:150 rpm for recycled material and 2:150 for virgin material; and II) calendering with no water circulation and no pressure and with a distance from calender flap of about 10 mm, flap opening: 0.55±0.05 mm to form a polymeric semiconductor plate.

After the "A" phase in which the polymeric semiconductor plates 2 based on lampblack are prepared a "B" phase is performed including cutting the plates 2 with a plurality of cutting blades.

After the "B" phase or stage a "C" phase is performed including printing an electric conductive track 3 on the plate 2. The steps in the "C" stage include:

a) cleaning the plate 2 with alcohol;

b) flaming or slightly burning the surface 4 of plate 2 which receives the electrical conductor track 3;

c) silk screen printing on a printing table with fixation of the plate 2 under vacuum and contour gauge, with the same contours of the heater model and with the same thickness of plate 2;

d) prior drying at room temperature during a predetermined proper time;

e) drying in a oven at 70° C. during 20 to 30 minutes; and f) fixing terminals 5 on the plate for the tracks printed during the silk screen printing.

The ink used is of a silver type.

Figure 2:
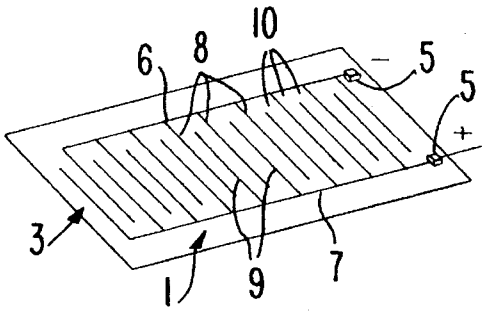
FIG. 2 is a perspective view of a heater made according to the invention.

The self-controlled heater which is a product of the above method is shown in the attached FIG. 2 and consists essentially of a semiconductor polymer substrate based on lampblack 1, composed of 60% low density polyethylene (PEBD), 8.5% ethylene vinyl acetate copolymer, 20% conductive lampblack porous structure, 4.0% spreading agent composed of calcium stearate, 3.0% antioxidant, and 0.5% calcium titanate, in which the present lampblack aggregations have a low degree of orientation and a high degree of shearing. This plate has printed on it a silver ink conductor track 3 including negative poles 6 and positive poles 7 linked to suitable terminals 5 and also having interpenetrating and adjacent branches 8 and 9 which are spaced at intervals 10 from each other. These and the above-mentioned interpenetrating branches 8 and 9 are conveniently dimensioned to provide the proper heat transfer to the area and/or space where the moisture level is to be controlled.

This heater with the above features can be made in various dimensions, shapes and capacities for heat transfer according to the individual application. An example of a preferred embodiment of this heater, which is useful for defrosting or defogging a mirror, particularly a rearview mirror of a motor vehicle, has the following specifications in Table I.

TABLE I

| Specifications of a Preferred Embodiment of a Self-controlled Heater | |
|---|---|
| Nominal Power: | 0.07 ± 10% W/cm$^2$ |
| Maximum Power: | 0.03 ± 10% W/cm$^2$ |
| Operating Voltages: | 22 to 29 V Dc (nominal value 24 V Dc) 10 to 15 V Dc (nominal value 12 V Dc) |
| Heater Area: | 80% of Glass Mirror surface |
| Temperature Specifications: | Storage: −40° C. to 60° C. Operation: −40° to 50° C. Glass Surface: 60° C. (max) to 23° C. |
| Life: | 100 h at 23° C. and 8 h at 50° C. at 14 to 28 V Dc under nominal operating voltage |
| Salt-spray: | 240 h according to ASTM 117B–Norm |
| Defrosting Power: | 80% of the glass surface in 7 minutes at −40° C. |

Figure 3:
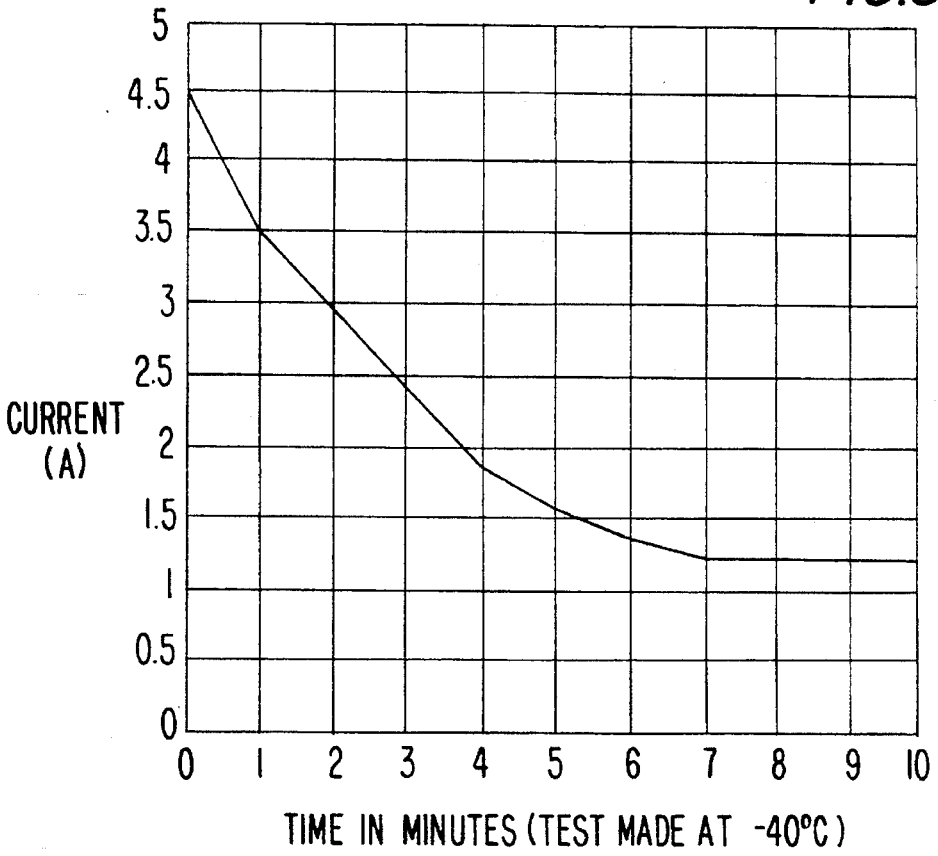
FIGS. 3 and 4 are graphical illustrations showing current versus heating time and % defrost versus heating time for the self-controlled heater according to the invention.
Figure 4:
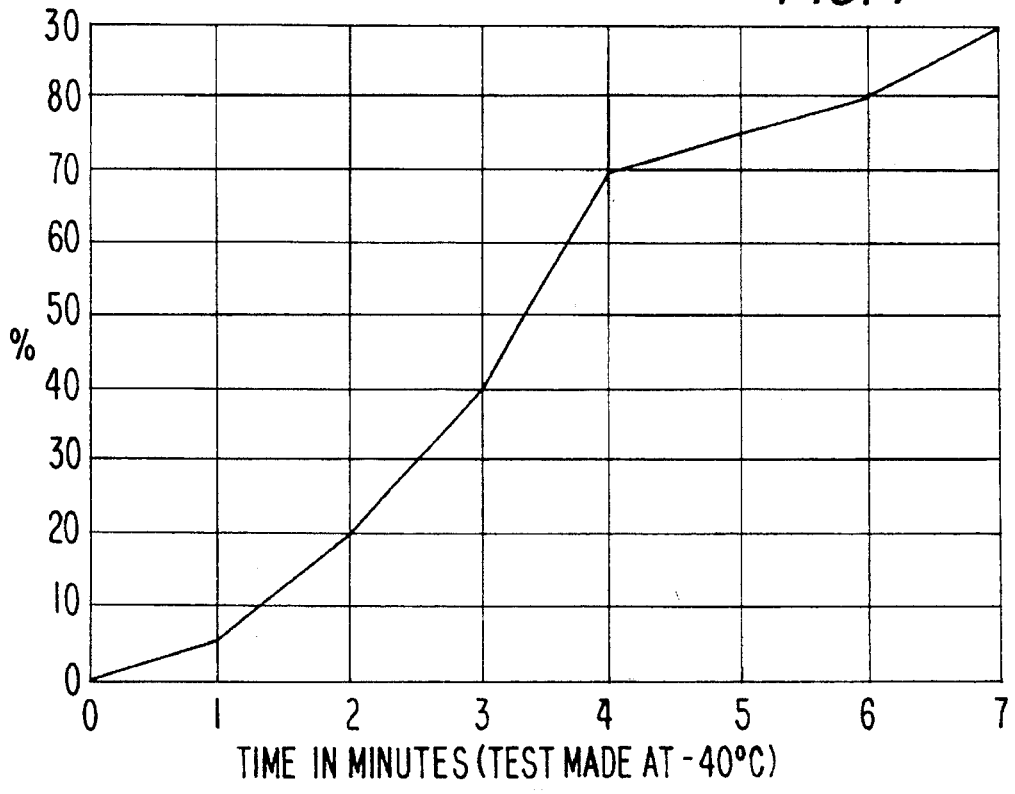

FIGS. 4 and 5 shows the properties of the preferred heater in use to clear a rearview mirror of a vehicle. FIG. 3 shows the dependence of the current on time when a voltage of 12 volts is applied to the terminals of the heater. FIG. 4 shows the behavior of the heater in defrosting a mirror to which it is attached. The y-axis shows the % defrost and the x-axis shows the time.

While the invention has been illustrated and described as embodied in a method of making a self-controlled heater and improved self-controlled heater made thereby, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. Self-controlled heater of a rearview mirror of a vehicle comprising:

a semiconductor polymer substrate consisting essentially of 60% low density polyethylene, 8.5% ethylene vinyl acetate copolymer, 20% conductive lampblack having a porous structure; 4.0% of a spreading agent consisting of calcium stearate; 3.0% of an antioxidant; and 0.5% of a coupling agent consisting of calcium titanate, with a high degree of shearing and a low degree of orientation for lampblack aggregations, a silver ink conductor track (3) printed on said substrate, said conductor track including negative and positive poles (8,9) having interpenetrating adjacent branches (8,9) spaced at intervals (10) from each other so as to provide a sufficient amount of heat to the rearview mirror for defogging and defrosting the rearview mirror; and two terminals (5) on said substrate, one of said two terminals (5) being connected to said negative pole and another of said two terminals (5) being connected to said positive pole.

* * * * *